US005495749A

United States Patent [19]

Dawson et al.

[11] Patent Number: 5,495,749

[45] Date of Patent: Mar. 5, 1996

[54] LEAK DETECTION ASSEMBLY

[75] Inventors: Gary D. Dawson, Rochester; William B. Blomquist, Clarkston, both of Mich.

[73] Assignee: Chrysler Corporation, Highland Park, Mich.

[21] Appl. No.: 500,108

[22] Filed: Jul. 10, 1995

Related U.S. Application Data

[63] Continuation of Ser. No. 245,796, May 19, 1994, abandoned, which is a continuation-in-part of Ser. No. 61,978, May 14, 1993, abandoned.

[51] Int. Cl.[6] ..... F02M 33/02

[52] U.S. Cl. ..... 73/49.7; 73/47; 73/118.1

[58] Field of Search ..... 73/46, 47, 49.7, 73/49.8, 118.1

[56] References Cited

U.S. PATENT DOCUMENTS

| | | | |
|---|---|---|---|
| 4,187,717 | 2/1980 | Wilhelm | 73/46 |
| 4,573,343 | 3/1986 | Huiber | 73/46 |
| 4,573,344 | 3/1986 | Ezekoye | 73/46 |
| 4,794,790 | 1/1989 | Margarit-Metaxa et al. . | |
| 4,821,701 | 4/1989 | Nankee, II et al. . | |
| 4,888,980 | 12/1989 | DeRome | 73/49.7 |
| 5,146,902 | 9/1992 | Cook et al. | 73/118.1 |
| 5,150,689 | 9/1992 | Yano et al. . | |
| 5,158,054 | 10/1992 | Otsuka . | |
| 5,172,672 | 12/1992 | Harada | 123/198 D |
| 5,182,945 | 2/1993 | Setter . | |
| 5,187,973 | 2/1993 | Kunze et al. . | |
| 5,187,974 | 2/1993 | Mellits et al. | 73/49.7 |
| 5,191,870 | 3/1993 | Cook | 123/520 |
| 5,193,512 | 3/1993 | Steinbrenner et al. . | |
| 5,239,858 | 8/1993 | Rogers et al. . | |
| 5,245,973 | 9/1993 | Otsuka et al. . | |
| 5,267,470 | 12/1993 | Cook . | |
| 5,275,144 | 1/1994 | Gross . | |
| 5,284,050 | 2/1994 | Iida et al. . | |
| 5,317,909 | 6/1994 | Yamada et al. . | |
| 5,383,437 | 1/1995 | Cook et al. . | |
| 5,408,866 | 4/1995 | Kawamura et al. . | |

FOREIGN PATENT DOCUMENTS

| | | |
|---|---|---|
| 2635823 | 8/1988 | France . |
| 2681098 | 9/1991 | France . |
| 2681098 | 3/1993 | United Kingdom . |

*Primary Examiner*—Richard Chilcot
*Assistant Examiner*—Eric S. McCall
*Attorney, Agent, or Firm*—Mark P. Calcaterra

[57] ABSTRACT

A leak detection assembly for an evaporative emission control system in an automotive vehicle including a fuel tank, a canister for collecting volatile fuel vapors from the fuel tank, a purge valve disposed between the canister and an intake manifold of an engine operative to allow flow of the fuel vapors from the canister to the intake manifold, a vacuum actuated pump in communication with the canister, and a vent control valve operative to selectively allow and prevent communication between the canister and an atmospheric vent of the vacuum actuated pump, the leak detection assembly including a three-port solenoid fluidly connected to the intake manifold and a second atmospheric vent, and a vacuum line fluidly connecting the three-port solenoid to the vent control valve, the three-port solenoid selectively communicating with the intake manifold to allow a vacuum in the vacuum line during a first operating mode to close the vent control valve and selectively communicating with the second atmospheric vent during a second operating mode to open the vent control valve.

3 Claims, 2 Drawing Sheets

LEAK DETECTION ASSEMBLY

CROSS REFERENCE TO RELATED APPLICATION

This is a continuation of U.S. patent application Ser. No. 08/245,796, filed May 19, 1994, abandoned, which is a continuation-in-part of application Ser. No. 08/061,978, filed May 14, 1993 abandoned.

BACKGROUND OF THE INVENTION

1. Field of the Invention

The present invention relates generally to an evaporative emission control systems for automotive vehicles and, more particularly, to a leak detection assembly for determining if a leak is present in a portion of an evaporative emission control system for an automotive vehicle.

2. Description of the Related Art

Modern automotive vehicles typically include a fuel tank and an evaporative emission control system that collects volatile fuel vapors generated in the fuel tank. The evaporative emission control system includes a vapor collection canister, usually containing an activated charcoal mixture, to collect and store volatile fuel vapors. Normally, the canister collects volatile fuel vapors which accumulate during refueling of the automotive vehicle or from increases in fuel temperature. The evaporative emission control system also includes a purge valve placed between an intake manifold of an engine for the automotive vehicle and the canister. The purge valve is opened by an engine control unit in an amount determined by the engine control unit to purge the canister; i.e., the collected volatile fuel vapors are drawn into the intake manifold from the canister for ultimate combustion within a combustion chamber of the engine.

Recently, governmental regulations have required that certain automotive vehicles powered by volatile fuels such as gasoline have their evaporative emission control systems checked to determine if a leak exists in the system. As a result, on board vehicle diagnostic systems have been developed to determine if a leak is present in a portion of the evaporative emission control system. One such diagnostic system utilizes a vacuum regulator/sensor unit to draw a vacuum on the evaporative emission control system and sense whether a loss of vacuum occurs within a specified period of time.

Diagnostic systems also exist for determining the presence of a leak in an evaporative emission control system which utilizes positive pressurization rather than negative pressurization, i.e. a vacuum. In positive pressurization systems, the evaporative emission control system is pressurized to a set pressure, typically through the use of an electric air pump. A sensor determines whether the pressure remains constant over a certain amount of time.

Positive pressurization systems have a benefit over negative pressurization systems in that the increased pressure suppresses the rate of fuel vapor generated in the fuel tank. Such a situation is desirable when a test is given under hot weather conditions which typically promote fuel vapor generation.

SUMMARY OF THE INVENTION

It is, therefore, one object of the present invention to provide a leak detection assembly for use in testing the integrity of an evaporative emission control system for an automotive vehicle.

It is another object of the present invention to provide a leak detection assembly having a three-port solenoid to actuate a vacuum actuated canister vent control valve.

It is yet another object of the present invention to provide a leak detection assembly having a check valve between the three-port solenoid and an intake manifold of an engine to maintain a vent control valve in a closed, sealed position during operation of a vacuum actuated pump.

To achieve the foregoing objects, the present invention is a leak detection assembly for an evaporative emission control system in an automotive vehicle including a fuel tank, a canister for collecting volatile fuel vapors from the fuel tank, a purge valve disposed between the canister and an intake manifold of an engine operative to allow flow of the fuel vapors from the canister to the intake manifold, a vacuum actuated pump in communication with the canister, and a vent control valve operative to selectively allow and prevent communication between the canister and an atmospheric vent of the vacuum actuated pump. The leak detection assembly includes a three-port solenoid fluidly connected to the intake manifold and a second atmospheric vent and a vacuum line fluidly connecting the three-port solenoid to the vent control valve. The three-port solenoid selectively communicates with the intake manifold to allow a vacuum in the vacuum line during a first operating mode to close the vent control valve and selectively communicates with the second atmospheric vent during a second operating mode to open the vent control valve.

One advantage of the present invention is that a leak detection assembly is provided for an evaporative emission control system of an automotive vehicle. Another advantage of the present invention is that the leak detection assembly has a three-port solenoid to close a vent control valve to seal the evaporative emission control system so that the leak detection test can be performed. Yet another advantage of the present invention is that the leak detection assembly includes a check valve between the three-port solenoid and the intake manifold to maintain the vent control valve in a closed, sealed position during operation of a vacuum actuated pump.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
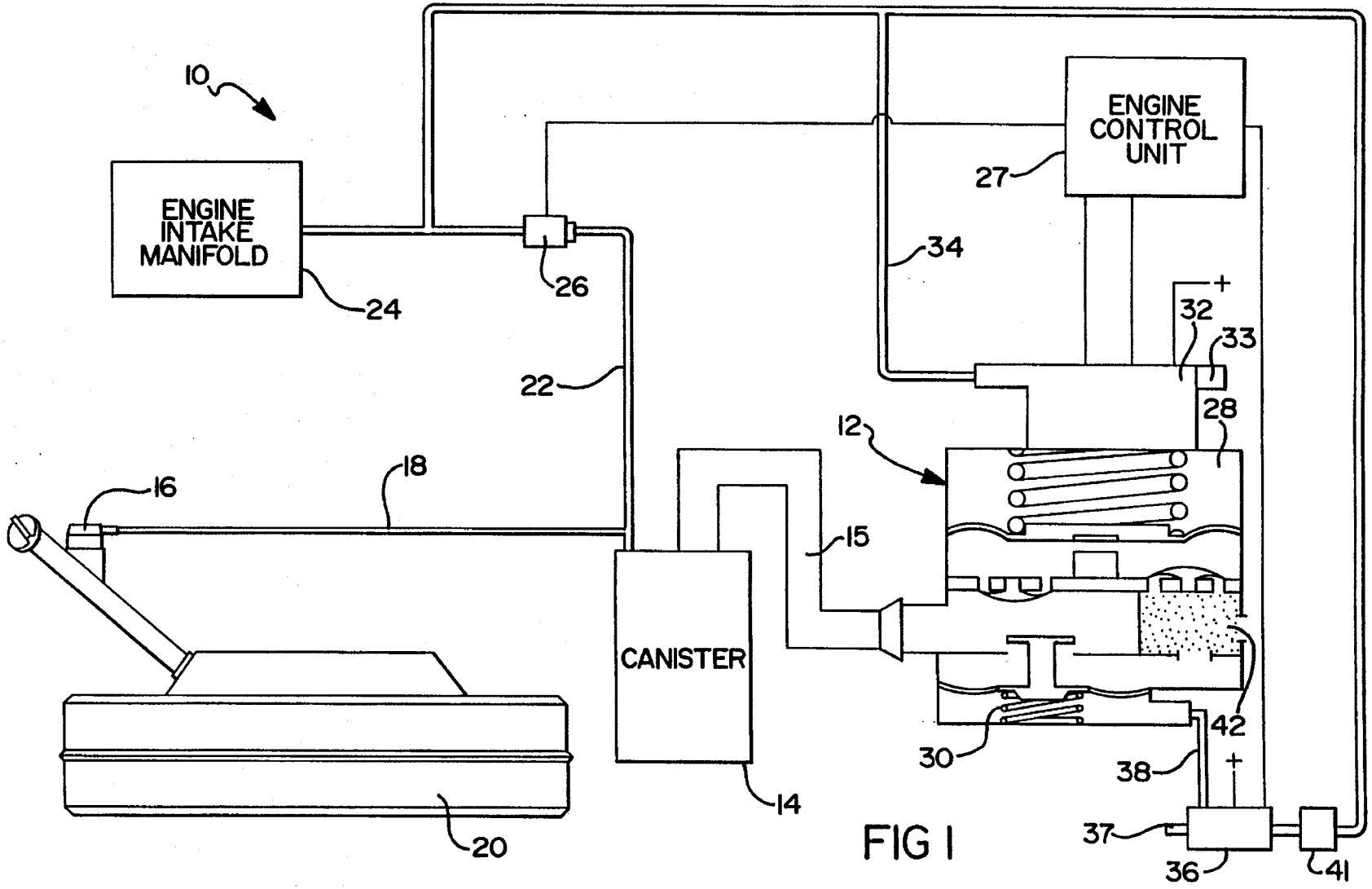
FIG. 1 is a schematic diagram of an evaporative emission control system utilizing a leak detection assembly, according to the present invention.

Referring to FIG. 1, an evaporative emission control system 10 is shown for an automotive vehicle (not shown) utilizing a leak detection system or assembly, according to the present invention and generally indicated at 12. The evaporative emission control system 10 includes a carbon canister 14 connected to the leak detection assembly 12 by a conduit 15. The evaporative emission control system 10 also includes a rollover and vapor flow control valve 16 and a conduit 18 connected to the carbon canister 14 and a fuel tank 20 of the automotive vehicle. The evaporative emission control system 10 includes a conduit 22 connected to an intake manifold 24 of an engine (not shown) of the automotive vehicle and to the canister 14. The evaporative emission control system 10 further includes a purge valve 26 mounted on the conduit 22 and an engine control unit 27 connected to and operative to control the leak detection assembly 12 and the purge valve 26.

In operation, a supply of volatile liquid fuel for powering the engine of the automotive vehicle is placed in the fuel tank 20. As fuel is pumped into the fuel tank 20 or as the temperature of the fuel increases, fuel vapors from the fuel pass through the conduit 18 and are received in the canister 14. Vapors are drawn from the canister 14 through the conduit 22 and purge valve 26, and into the intake manifold 24 for ultimate combustion within combustion chambers (not shown) of the engine. During vehicle operation, the purge valve 26 is normally closed. Under certain conditions conducive to purging, the engine control unit 27 energizes a solenoid of the purge valve 26 to open the purge valve 26 such that a certain amount of engine vacuum from the intake manifold 24 is delivered to the canister 14 causing the collected fuel vapors to flow from the canister 14 through the purge valve 26 to the intake manifold 24 for combustion in the combustion chambers of the engine.

As illustrated in FIG. 1, the leak detection assembly 12 includes a vacuum actuated pump 28 and a vacuum actuated canister vent control valve 30. The leak detection assembly 12 also includes a first three-port solenoid 32 having a first atmospheric vent 33 and a conduit 34 connected to the first three-port solenoid 32 and the conduit 22 between the intake manifold 24 and purge valve 26. The first three-port solenoid 32 is electrically connected to the engine control unit 27 and a power source (+). The leak detection assembly 12 includes a second three-port solenoid 36 having a second atmospheric vent 37 and a vacuum line or conduit 38 interconnecting the second three-port solenoid 36 and the vent control valve 30. The second three-port solenoid 36 is electrically connected to the engine control unit 27 and a power source (+). The leak detection assembly 12 further includes a conduit 40 connected to the second three-port solenoid 36 and the conduit 34. The leak detection assembly 12 may include check valve 41 positioned on the conduit 40 to maintain the vacuum during short term operating conditions that would otherwise cause the vent control valve 30 to open. It should be appreciated that the vent control valve 30 seals or closes the conduit 15 between the canister 14 and an atmospheric vent and air filter 42 in order to positively pressurize the evaporative emission control system 10.

In accordance with the present invention, the leak detection assembly 12 is used to perform a test on the integrity of the evaporative emission control system 10. To conduct the test, the engine control unit 27 closes the purge valve 26 and energizes the second three-port solenoid 36 to draw a vacuum from the intake manifold 24. The vent control valve 30 is vacuum actuated such that the vacuum drawn by the second three-port solenoid 36 results in a corresponding vacuum being drawn through the conduit 38 connected to the vent control valve 30 which causes the vent control valve 30 to close and seal the canister 14 from the atmospheric vent and air filter 42. Once the conduit 15 is sealed off, the engine control unit 27 energizes the first three-port solenoid 32 to actuate the vacuum actuated pump 28 and positively pressurize the canister 14 and fuel tank 20 to a predetermined pressure. Once the predetermined pressure is reached, the vacuum actuated pump 28 ceases operation. If the evaporative emission control system 10 has a leak, the pressure is reduced and the vacuum actuated pump 28 will sense the reduced pressure and will actuate. The vacuum actuated pump 28 will continue to pump at a rate which will be representative of the flow characteristic as related to the size of the leak. From this information, it can be determined if the leak is larger or smaller than the required detection limit set by federal governmental standards.

Figure 2:
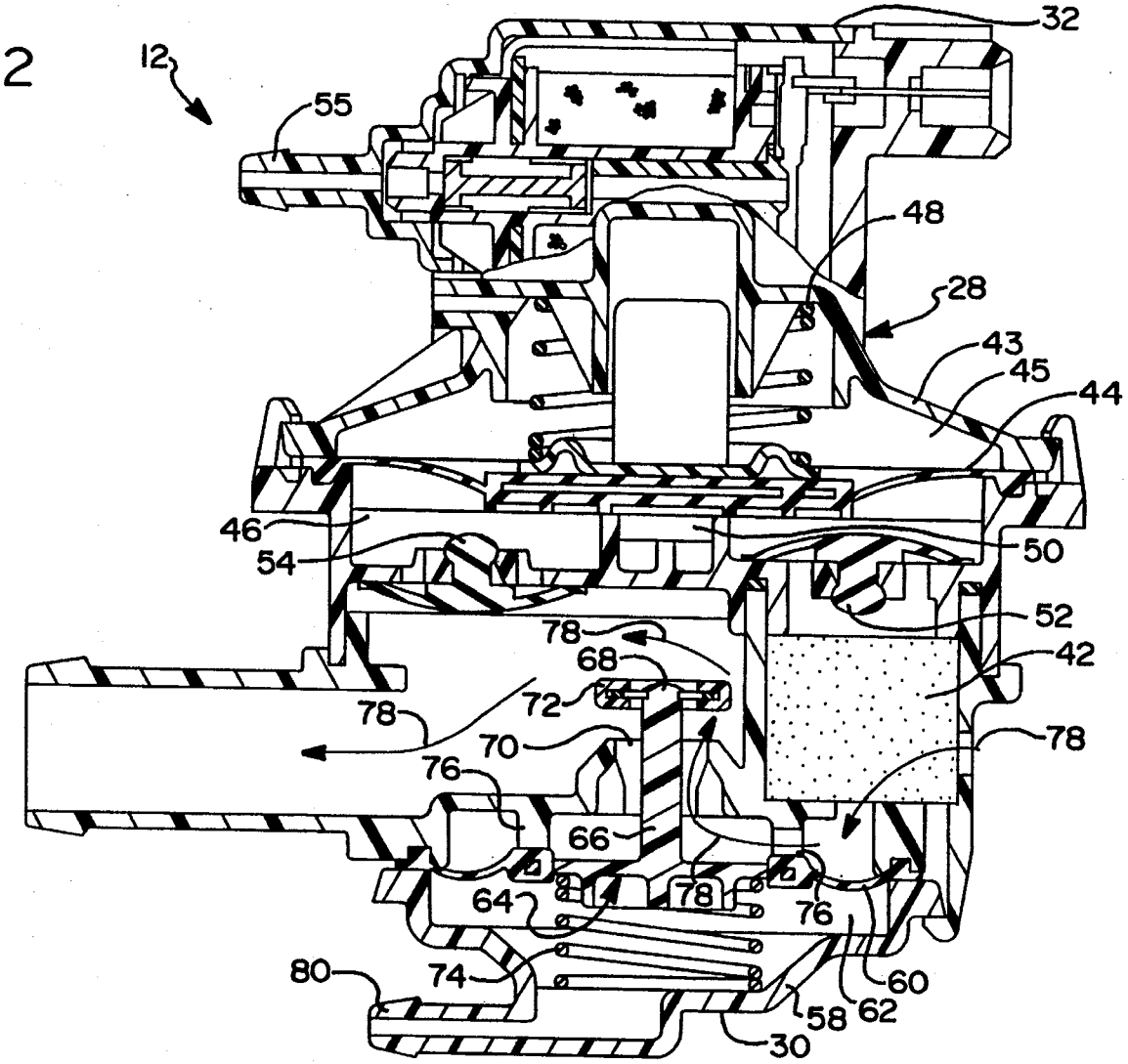
FIG. 2 is a fragmentary view of a portion of the leak detection assembly of FIG. 1.

Referring now to FIG. 2, the vacuum actuated pump 28 includes a housing 43 and diaphragm 44 disposed within the housing 43 and cooperates with the housing 40 to define a pump actuation cavity 45 and a pump chamber 46. The vacuum actuated pump 28 also includes a spring 48 disposed within the pump actuation cavity 45 and acts on the diaphragm 44. The vacuum actuated pump 28 includes a switch 50 mounted to the housing 43 and electrically connected to the engine control unit 27. The vacuum actuated pump 28 includes a pair of one way check valves 52, 54 disposed in the housing 43. The vacuum line 34 extends from and couples the vacuum drawn by the intake manifold 24 to an inlet port 55 of the first three-port solenoid 32. The first three-port solenoid 32 is connected to the housing 43 and upon receiving a signal from the engine control unit 27 selectively draws and releases a vacuum in the pump actuation cavity 45. It should be appreciated that when a vacuum is drawn in the pump actuation cavity 45, the diaphragm 44 is pulled upward against the spring 48. When the vacuum is released, the diaphragm 44 is then urged outward by the spring 48 in a pump stroke. It should also be appreciated that the switch 50 is placed adjacent the diaphragm 44 such that when the diaphragm 44 reaches a point in its stroke, the switch 50 is closed. It should further be appreciated that closure of the switch 50 sends a signal to the engine control unit 27 to energize the first three-port solenoid 32 and supply a vacuum to the pump actuation cavity 45.

In operation, the first three-port solenoid 32 is energized by the engine control unit 27, and connects the pump actuation cavity 45 with the vacuum drawn by the intake manifold 24 to initialize the vacuum actuated pump 28 by drawing the diaphragm 44 upward and compressing the spring 48. Drawing the diaphragm 44 upward draws air into the pump chamber 46. The first three-port solenoid 32 is then de-energized which allows atmospheric pressure to enter the pump actuation cavity 45, whereby the spring 48 drives the diaphragm 44 outward to force the air out of the pump chamber 46 through the second one way or check valve 54 into the canister 14 and corresponding elements of the evaporative emission control system 10 through the connecting conduit 15. As the diaphragm 44 reaches a point in its stroke, the switch 50 closes. Closure of switch 50 signals the engine control unit 27 to energize the first three-port solenoid 32 and provide a vacuum to the pump actuation cavity 45. In this manner, the cycle is repeated to create flow in a typical diaphragm pump fashion.

As illustrated in FIG. 2, during normal operation of the vehicle, the canister 14 is coupled to the atmospheric vent and air filter 42 through the vent control valve 30. In order to pressurize the evaporative emission control system 10, the vent control valve 30 must be closed. The vent control valve 30 includes a housing 58 and a diaphragm 60 extending across the housing 58 and in combination with the housing 58 defines a vacuum chamber 62. The vent control valve 30 also includes a valve 64 connected to the diaphragm 60. The valve 64 includes a valve stem 66 connected to the diaphragm 60 on one end. The valve 64 also includes a valve head 68 disposed on the valve stem 66 opposite the diaphragm 60. The vent control valve 30 further includes an opening or orifice 70 in the housing 58 to allow communication between the canister 14 and the atmospheric vent and air filter 42. The vent control valve 30 includes a seal element 72 disposed about the valve head 68 which engages and seals the orifice 70 to seal off the canister 14 from the atmospheric vent and air filter 42. The vent control valve 30 also includes a spring 74 disposed in the vacuum chamber 62 which acts upon the valve 64 to urge the valve 64 into an open position such that the diaphragm 60 is seated on projections 76 extending outward from the orifice 70. The vent control valve 30 further includes a port 80 connected to the conduit 38. It should be appreciated that when the valve 64 is in an open position, air may be drawn through the atmospheric vent and air filter 42 past the valve 64 and into the canister 14 in the direction shown by the arrows 78.

In order to pressurize the evaporative emission control system 10, the valve 64 must be closed. The valve 64 is urged closed when the second three-port solenoid 36 is energized causing a vacuum to be drawn in the vacuum chamber 62. The vacuum drawn in the vacuum chamber 62 acts against the spring 74 to draw the valve 64 into a closed position wherein the seal element 72 engages the orifice 70. The valve 64 is urged open by the spring 74 when the second three-port solenoid 36 is de-energized, causing atmospheric pressure from the second atmospheric vent 37 to communicate with the vacuum chamber 62 via the three-port solenoid 36 and conduit 38.

Once the vent control valve 30 is sealed, the first three-port solenoid 32 is cycled through periods of energizing and de-energizing causing the vacuum actuated pump 28 to pump air through the pump chamber 46 into the evaporative emission control system 10. The spring 48 in the pump actuation cavity 45 is set to a control pressure of about five inches (5") of water ($H_2O$). The cycle rate of the vacuum actuated pump 28 is quite rapid and the control pressure is quickly achieved. Once the control pressure is achieved, the cycle rate starts to drop off. If there is no leak in the evaporative emission control system 10, the vacuum actuated pump 28 will stop pumping. If a leak exists, the vacuum actuated pump 28 will continue to pump at a rate that will be representative of the flow characteristics of the size of the leak. Since the pump rate is now known, it can be determined if the leak is larger or smaller than the required governmental leak limit.

After passing the leak detection phase of the test, a flow test is performed wherein the engine control unit 27 energizes the purge valve 26 which in effect creates a leak. The cycle rate of the vacuum actuated pump 28 is then checked. The rate of the vacuum actuated pump 28 should increase due to the flow through the purge valve 26. It should be appreciated that the purge valve 26 is opened to a predetermined amount which results in a specified flow characteristic, and the pump rate should correspond to the flow characteristics.

Once the diagnostic test is complete, the first three-port solenoid 32 is de-energized which allows atmospheric pressure to bleed into the pump actuation cavity 45 and correspondingly the second three-port solenoid 36 is de-energized to allow atmospheric pressure into the vacuum chamber 62 to allow the spring 74 to open the vent control valve 30. Normal purge flow is then initiated.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. In a leak detection assembly for an evaporative emission control system in an automotive vehicle including a fuel tank, a canister for collecting volatile fuel vapors from the fuel tank, a purge valve disposed between the canister and an intake manifold of an engine operative to allow flow of the fuel vapors from the canister to the intake manifold, a vacuum actuated pump in communication with the canister having a first three-port solenoid fluidly connected to the intake manifold, and a vent control valve operative to selectively allow and prevent communication between the canister and a first atmospheric vent of the vacuum actuated pump, said leak detection assembly comprising:

a second three-port solenoid fluidly connected to the vacuum actuated pump and the intake manifold and a second atmospheric vent;

a vacuum line fluidly connecting said second three-port solenoid to the vent control valve, said second three-port solenoid selectively communicating with the intake manifold to allow a vacuum in said vacuum line during a first operating mode to close the vent control valve and selectively communicating with said second atmospheric vent during a second operating mode to open the vent control valve; and an engine control unit electrically connected to said first three-port solenoid of the vacuum actuated pump and the purge valve and said second three-port solenoid for closing the purge valve and for energizing said second three-port solenoid to close the vent control valve and seal the canister and for energizing the first three-port solenoid of the vacuum actuated pump to pressurize the evaporative emission control system and for de-energizing said first three-port solenoid of the vacuum actuated pump and said second three-port solenoid to open the vent control valve to depressurize the evaporative emission control system.

2. A leak detection assembly as set forth in claim 1 including a check valve disposed on said vacuum line connecting said second three-port solenoid with the intake manifold.

3. In a leak detection assembly for an evaporative emission control system in an automotive vehicle including a fuel tank, a canister for collecting volatile fuel vapors from the fuel tank, a purge valve disposed between the canister and an intake manifold of an engine operative to allow flow of the fuel vapors from the canister to the intake manifold, a vacuum actuated pump in communication with the canister having a first three-port solenoid fluidly connected to the intake manifold, and a vent control valve operative to selectively allow and prevent communication between the canister and a first atmospheric vent of the vacuum actuated pump, said leak detection assembly comprising:

a second three-port solenoid fluidly connected to the vacuum actuated pump and the intake manifold and a second atmospheric vent;

a vacuum line fluidly connecting said second three-port solenoid to the vent control valve, said second three-port solenoid selectively communicating with the intake manifold to allow a vacuum in said vacuum line during a first operating mode to close the vent control valve and selectively communicating with said second atmospheric vent during a second operating mode to open the vent control valve;

a check valve disposed on said vacuum line connecting said second three-port solenoid with the intake manifold; and an engine control unit electrically connected to said first three-port solenoid of the vacuum actuated pump and the purge valve and said second three-port solenoid for closing the purge valve and for energizing said second three-port solenoid to cause a vacuum to be drawn in and close the vent control valve and seal the canister and for energizing said first three-port solenoid of the vacuum actuated pump to pressurize the evaporative emission control system and for de-energizing said first three-port solenoid of the vacuum actuated pump and said second three-port solenoid to cause atmospheric pressure from said second atmospheric vent to be drawn in and open the vent control valve to de-pressurize the evaporative emission control system.

* * * * *